US006220783B1

(12) United States Patent
Maxwell

(10) Patent No.: US 6,220,783 B1
(45) Date of Patent: Apr. 24, 2001

(54) RUMBLE STRIP CUTTER

(76) Inventor: James F. Maxwell, 722 E. 2730 North, Provo, UT (US) 84604

( * ) Notice: Subject to any disclaimer, the term of this patent is extended or adjusted under 35 U.S.C. 154(b) by 0 days.

(21) Appl. No.: 09/479,742

(22) Filed: Jan. 7, 2000

(51) Int. Cl.[7] ..... G01C 11/24
(52) U.S. Cl. ..... 404/94; 404/93
(58) Field of Search ..... 404/14, 94, 90, 404/93, 72, 19

(56) References Cited

U.S. PATENT DOCUMENTS 5,456,547 * 10/1995 Thomas et al. ..... 404/72
5,484,228 * 1/1996 Thomas et al. ..... 404/90
5,582,490 * 12/1996 Murray ..... 404/90
5,676,490 * 10/1997 Nelson ..... 404/94
5,695,299 * 12/1997 Thomas et al. ..... 404/94
5,743,247 * 4/1998 Kingsley et al. ..... 404/94
5,851,086 * 12/1998 Kurasako ..... 404/94
5,957,620 * 9/1999 Thomas et al. ..... 404/72

* cited by examiner

*Primary Examiner*—David Bagnell
*Assistant Examiner*—Raymond Addie
(74) *Attorney, Agent, or Firm*—James L Sonntag

(57) ABSTRACT

An apparatus and method for milling rumble strips into a pavement surface with a cutting wheel. The cutting wheel has rows of a cutting and non-cutting surface and is rotated to alternately present and withdraw a cutting surface and a non-cutting surface to the asphalt and cut a periodic rumble strip pattern as the apparatus moves forward. This alternating pattern is achieved without any up and down motion of the cutting wheel, and the apparatus can be operated a relatively rapid speed.

6 Claims, 4 Drawing Sheets

RUMBLE STRIP CUTTER

RELATED APPLICATIONS (Not applicable)

STATEMENT REGARDING FEDERALLY SPONSORED RESEARCH OR DEVELOPMENT (Not applicable)

FIELD OF THE INVENTION

This invention relates to an apparatus for cutting rumble strips into asphalt or cement pavement.

BACKGROUND OF THE INVENTION

Rumble strips are typically installed in new asphalt pavement by pressing depressions perpendicular to forward direction of travel when it is still hot during installation of the pavement. This is accomplished by a roller with steel bars of suitable size and spacing with adequate weight to form the depressions.

It is often desirable to install rumble strips in asphalt that is already installed, or to increase the width of the rumble strip depressions to increase the magnitude of rumble effect. To this end, machines have been designed and built to mill wider depressions in cold asphalt pavement along the shoulder of roads. These rumble strip milling machines typically use the same type of cutting teeth used on large asphalt milling machines. The teeth are mounted on a cylindrical cutting head, with a diameter the same as the arch of the depressions to be milled. As the milling machine moves forward, the cutting or milling head is rotated at a rapid rate against the forward motion of the milling machine to cut into the pavement. Since the cutting must be periodic and not continuous to form a rumble strip, the cutting head is raised and lowered at regular intervals to leave unmilled areas between the milled depressions. Accordingly, during the forward travel of the milling machine it is necessary to continuously move the cutting head up and down in a regular periodic motion. This up and down motion must be carefully coordinated with the forward speed of the milling machine. This coordinated motion severely limits the forward speed of the milling machine. Typically the forward speed of these rumble strip cutters can be no greater than one or two miles per hour, making the process a relatively slow procedure.

The up and down motion of the cutting head not only limits the speed of the milling machine, but adds significantly to the mechanical complexity and cost of the machine. Accordingly, there is a continuing need in the art to a rumble strip cutting system that not only permits a faster cutting speed but also is a mechanically simpler method than existing systems. A desirable system would be mechanically simpler, and thus more reliable and allow for a faster forward speed of the milling machine.

Objects of the Invention

It is, therefore, an object of the invention to provide a rumble strip milling apparatus that can cut rumble strips while traveling significantly faster that prior-art systems.

Another object of the invention is a rumble strip milling apparatus that is mechanically simpler than existing systems.

Further objects of the invention will become evident in the description below.

BRIEF SUMMARY OF THE INVENTION

The present invention involves a milling machine and method for cutting rumble strips into pavement, such as asphalt and Portland cement. The present invention involves a cutting wheel with alternating rows of cutting teeth. The cutting wheel is mounted with the cutting rows transverse to the direction of travel and it is rotated at a fixed distance above the pavement to move the cutting rows in and out of cutting position as the milling machine moves forward.

As the teeth on the cutting wheel are rotated in and out of cutting position, the forward motion of the machine provides the cutting force as the row of cutting teeth are dragged along the pavement to cut a depression in the pavement. The cutting row is then rotated from cutting into the pavement, leaving an uncut portion as the machine continues its forward motion. In this manner periodic cut and uncut portions are provided, which together form a rumble strip.

The invention is contrary to prior-art practice where the cutting wheel is rotated rapidly to provide the cutting force for the wheel and the wheel is moved up and down as the machine moves forward.

Since the rotating of the cutting wheel enables the milling machine to form the periodic cuts, it is not necessary to move the cutting wheel up and down. Accordingly, the cutting wheel rotates at a fixed distance above the pavement, such that the cutting rows cut into the pavement when they are at the bottom of the cutting wheel, and an uncut portion is left when the non-cutting surface is at the bottom of the cutting wheel.

In order that the forward motion provide the cutting force for the teeth in the cutting rows, the teeth must be dragged across the pavement, i.e., the peripheral speed of the cutting wheel is slower than or opposite the speed of the pavement under a cutting row as it cuts. There are several ways of accomplishing this end. One method, as illustrated in Example I, is to provide a cutting wheel that turns at the same RPM rate and in the same direction as a drive wheel of the machine, but where the cutting wheel has a smaller diameter. In this instance the forward side of the wheel is turning down, like the drive wheel, but because the peripheral speed of the cutting wheel is lower, its cutting rows are dragged along the pavement when in cutting position. Another method, as illustrated in Example II, is to provide cutting wheels that turn opposite the forward motion.

In any case, it is important that the cutting wheels function to present and withdraw a cutting row for cutting. In addition, the arc and spacing of the depression must be correct. Accordingly, the cutting wheel diameter, the number of cutting rows on the cutting wheel, rotation speed and direction, must be chosen to achieve the desired ends. In addition, the peripheral speed of the cutting wheel and the forward motion must be proportionally coordinated in order to provide a strip of regular periodic cut depressions.

Coordinating the forward speed and cutting wheel speed together proportionally is mechanically simpler and more trouble free than coordinating the up and down motion of a cutting wheel and its drive mechanism. Without the requirement of a up and down motion of cutting wheels, it is possible for the apparatus of the present invention to travel much faster than prior-art systems, up to 20 to 30 miles per hour. The order of magnitude increase in speed, and the overall simplicity of the present system, over prior-art systems, allows for a significant savings in capitol and operating costs.

INDEX OF REFERENCE NUMBERS

Figure 1:
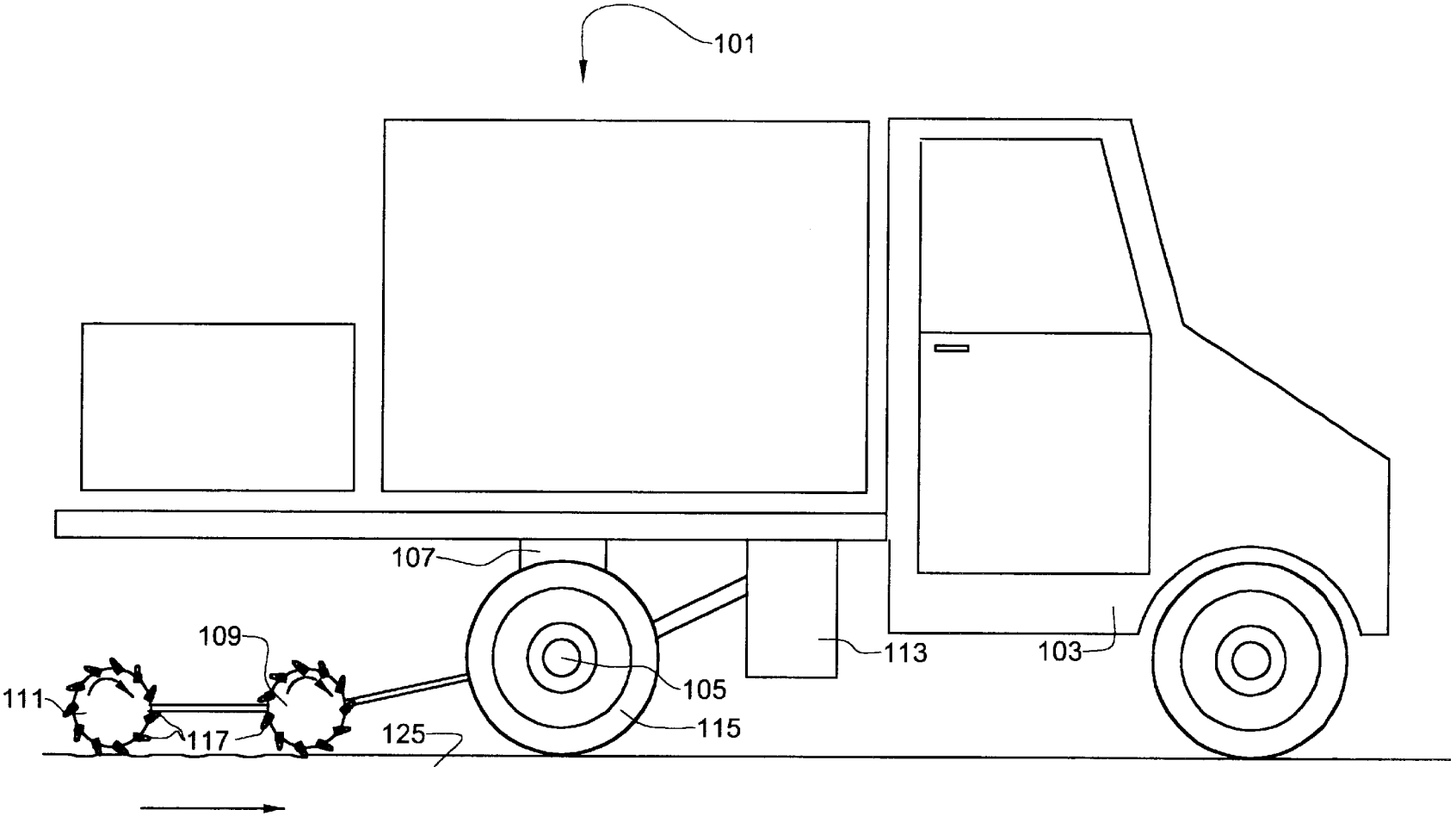
FIG. 1 is schematic side view of an apparatus of the invention
Figure 2:
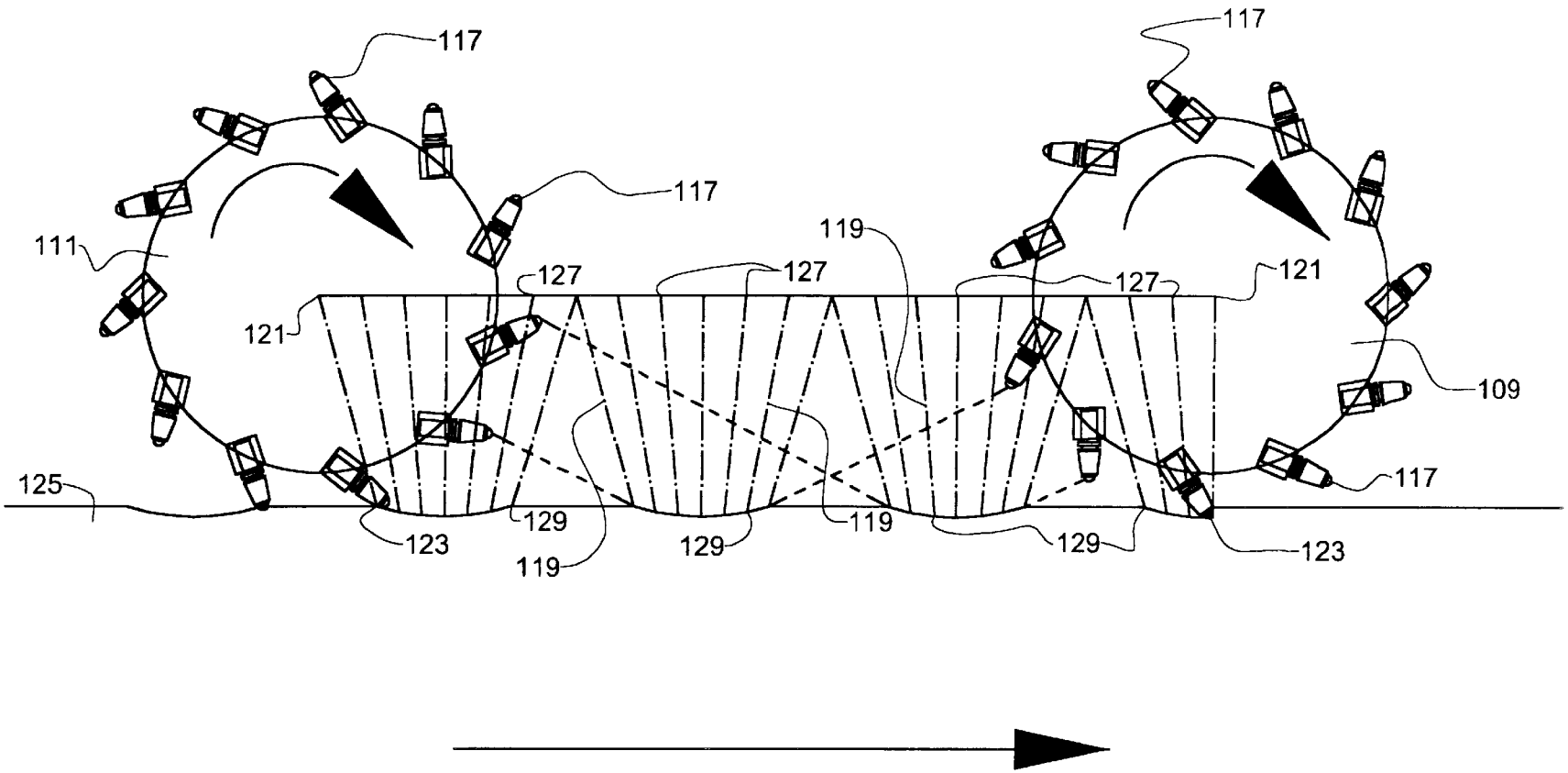
FIG. 2 is a schematic of the cutting wheels of the apparatus in FIG. 1, illustrating the motion of the cutting wheels relative to the forward motion of the apparatus.

FIGS. 1 and 2
101 apparatus of the invention
103 truck
105 rear drive axle
107 air bags
109 forward cutting wheel
111 rear cutting wheel
113 transfer case
115 drive wheels
117 cutting teeth
119 radius lines
121 center of cutting wheel
123 tip of cutter
125 pavement
127 wheel center locations
129 cutting tip locations
FIGS. 3, 4 and 5
301 apparatus of the invention
303 truck
305 rear drive axle
309 cutting wheel
310 cutting wheel
311 cutting wheel
312 cutting wheel
315 drive wheels
317 cutting teeth
319 radius lines
321 center of cutting wheel
323 tip of cutter
325 pavement
327 wheel center locations
329 cutting tip locations

DETAILED DESCRIPTION OF THE INVENTION

EXAMPLE I

Reference is now made to FIG. 1, which a schematic diagram of a rumble strip milling machine of the invention 101. A large truck 103 with a suitable wheelbase and at least one rear drive axle 105 provides a forward motion to the apparatus. The truck is equipped with air bags 107 over the rear axle 105 to raise and lower the frame of the truck. Forward and trailing cutting wheels 109, 111 are mounted behind the drive axle. Two cutting wheels 109, 111 are mounted on two truck axles with the same gear ratios as the drive axle for the drive wheels of the truck. The cutting wheels 109, 111 are driven through a transfer case 113 to allow engagement or disengagement of the cutting wheels. The diameter of the cutting wheels 109, 111 is one half the diameter of the drive wheels, so that the peripheral speed of the cutting wheels 109, 111 is one-half of the drive tire or ground speed.

As an example, if the drive wheel is 42 inches in diameter, the diameter of the cutting heads (from the tips of the cutters) is 21 inches. Usually the spacing between rumble strips is 12 inches. Therefore, the spacing between the cutting teeth rows on the milling head must be 6 inches. The cutting head has a circumference of about 66 inches, thus 11 rows of cutting teeth are spaced around the circumference of the wheel, at about 6 inch intervals.

During operation of the milling machine the cutting wheels are lowered to the pavement surface by deflating the air bags 107 to dead axle. The apparatus is driven forward and the cutting wheels 109, 111 are dragged or pulled over the surface while being rotated forward, as indicated by the arrows. To provide weight in the cutters so that they will cut into the pavement, the vehicle may be weighted by any suitable means, for example, by a water tank. Auxiliary equipment used in pavement milling machines may also be provided, such as, for example, spray bars over the cutters, covers over the cutting wheels, compressed air for cleaning, noise suppression devices, and the like.

Reference is now also made to FIG. 2, which is a schematic illustrating the cutting wheels 109, 111. The cutting wheels 109, 111 comprise rows of cutting teeth 117 (only one tooth in each row is shown for clarity) with spaces 119 without cutting teeth between the rows. To illustrate the motion of the cutting teeth rows as the wheel rotates and moves forward radius lines 119 are shown below between the center of the cutting wheel 109, 111 and the tip of a cutter 123 cutting into pavement 125. The cutting wheel moves forward at a constant speed as shown by the equal spacing of the wheel center locations 127. However, the speed of a cutting tip is less, by one-half in this example, when it is cutting into the pavement. This is shown by the spacing between the corresponding cutting tip locations 129. As a result of the lower speed of the cutting wheel the cutting teeth are dragged along the pavement, which provides the cutting force for the milling of the depression by the teeth 117. Thus, although the wheel is rotating forward side down, the cutting teeth 117 are set to cut up.

EXAMPLE II

Figure 3:
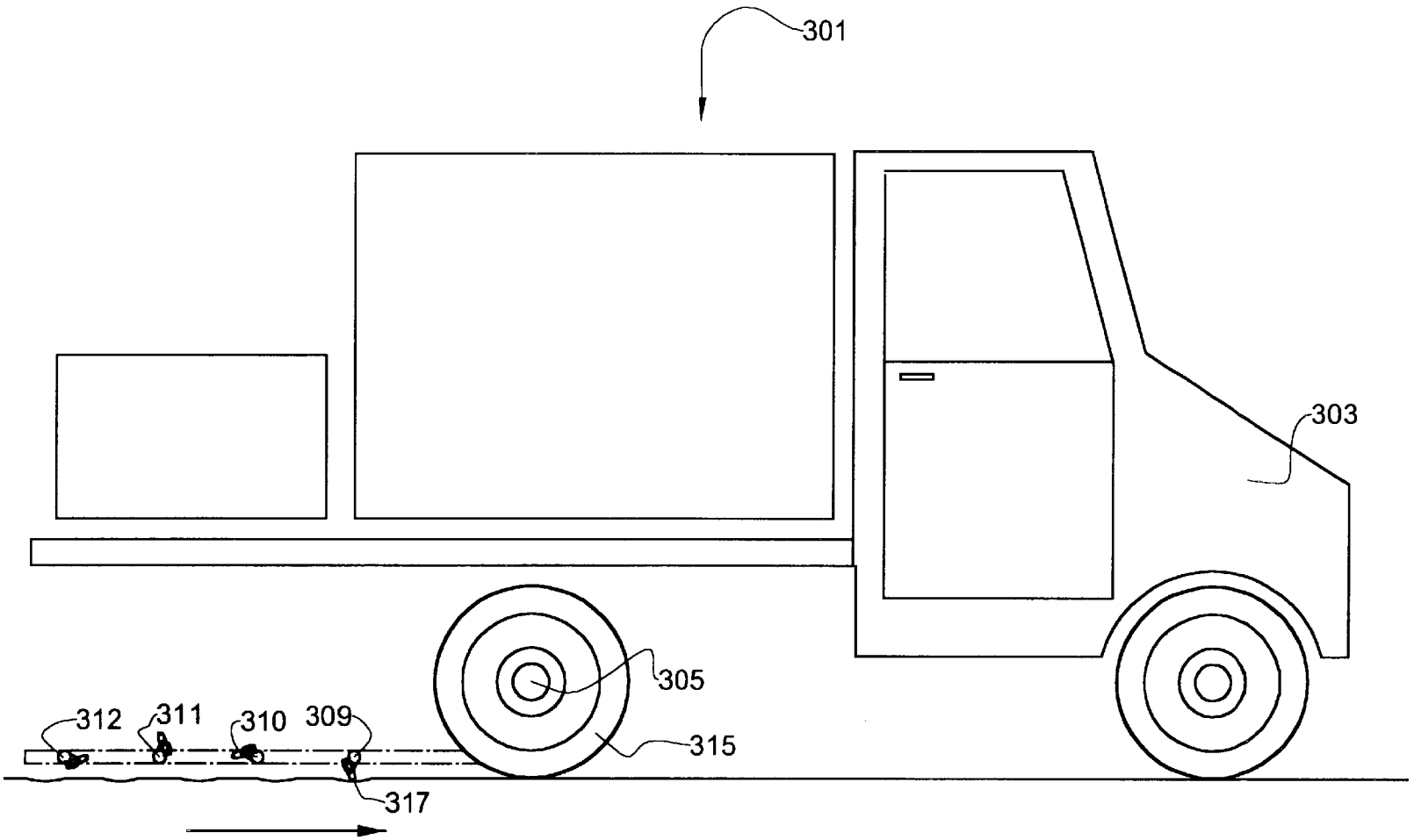
FIG. 3 is a schematic of an alternate apparatus of the invention.

Reference is now made to FIG. 3, which a schematic diagram of an alternate rumble strip milling machine of the invention 301. A truck 303 with a suitable wheelbase and at least one rear drive axle 305 provides a forward motion to the apparatus. Four cutting wheels 309, 310, 311, 312 are mounted behind the drive axle. The truck is equipped with suitable means to raise and lower the cutting wheels (not shown).

With driving wheels 315 on the machine of about 30.56 inches in diameter, and the cutting wheel one-fourth of that diameter (from tips of teeth—7.64 inches) a ratio of 8:1 would turn cutting teeth on the cutting heads twice as fast as the forward motion of the milling apparatus. The circumference of the cutting heads is about 24 inches which means that the teeth would travel 24 inches in a circular motion for very 12 inches of forward motion. Using four cutting wheels mounting 15 inches part, each cutting wheel having one row of cutting teeth. In the four cutting wheels, the cutting rows are oriented 90° out of phase (e.g., 6, 9, 12, and 3 o'clock).

During operation of the milling machine the cutting wheels are lowered, and the apparatus is driven forward and the cutting wheels 309, 310, 311, 312 are dragged or pulled over the surface while being rotated forward, as indicated by the arrows.

Figure 4:
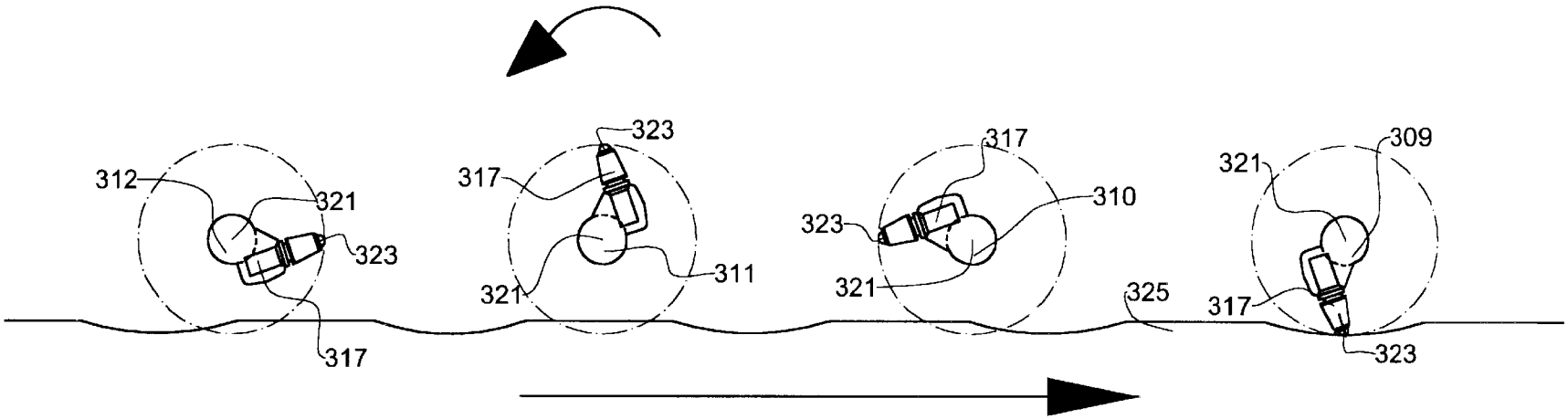
FIG. 4 is a schematic showing in greater detail the cutting wheels of the apparatus of FIG. 3.
Figure 5:
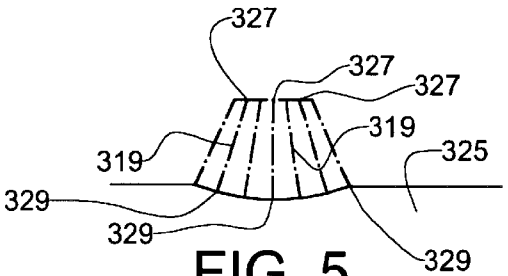
FIG. 5 is a schematic illustrating the motion of the cutting teeth relative to the forward motion of the apparatus of FIG. 3.

Reference is now also made to FIGS. 4 and 5, which are, respectively, a schematic illustrating the cutting wheels 309, 310, 311, 312, and a schematic showing radius lines of a moving wheel. The cutting wheels comprise a row of cutting teeth 317 with a space 319 without cutting teeth. To illustrate the motion of the cutting teeth rows as the wheel rotates and moves forward (See FIG. 5) are radius lines 319, i.e., the lines between the center 327 of a cutting wheel and the tip 329 of a cutter cutting into pavement 325. The cutting wheel moves forward at a constant speed as shown by the equal spacing of the wheel center locations 327. However, the speed of a cutting tip 329 is faster the wheel center when it is cutting into the pavement. This is shown by the corresponding cutting tip locations 329.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

For example, the cutting wheel could be mounted with its axis at an angle to the forward motion of the machine. The teeth would then be oriented in helical rows to cut the depressions straight across. The depressions would be similar to those of the above examples, but be parallelogram-shaped.

An apparatus of the invention may have one or a plurality of cutting wheels. A second cutting wheel may be used to cut in the same depression as a first cutting wheel to finish the shape and texture of the depression, as illustrated in the examples. In addition, a following cutting heads may be disposed to cut in between depressions cut by one or more leading cutting wheels.

Any system for providing and coordinating the peripheral speed of the cutting wheel and the forward motion is contemplated. Preferably, conventional power transfer systems that turn both the drive and cutting wheels at the same speed are used, using a smaller diameter for the cutting wheel. Other methods of coordinating these speeds is contemplated, using, for example, any combination of synchronized motors, gear boxes, electronic speed controllers and governors, and the like. The only requirement is that the peripheral speed of the cutting wheel be coordinated with the forward speed as recited in the claims.

In addition, the milling apparatus need not be on a motorized truck or be self propelled, as illustrated, but could be towed as a trailer, the requirements being that there by some motor or like for imparting forward motion and that the cutting wheel speed can be proportionally linked with the forward speed. The exact dimensions of the various components of the milling machine, in particular, the drive and cutting wheel diameters, the cutting row spacing, and the ratio between the speeds of the drive and cutting wheels, depends upon the dimensions of the rumble strip, the configuration of the drive mechanism, etc, The exact dimensions and configuration for any particular milling machine of the invention is well within the skill of an ordinary practitioner in the art to determine.

What is claimed is:

1. A milling apparatus for milling rumble strips into pavement comprising;

a device for imparting forward motion to the milling apparatus, at least one cutting wheel comprising at least one cutting row of pavement cutters and at least one non-cutting surface disposed transversely at a periphery of the cutting wheel to present alternating cutting and non-cutting surfaces as the cutting wheel rotates, a cutting wheel rotator for rotating the cutting wheel at a speed proportional to the forward motion and at a fixed distance above the pavement, such that the at least one cutting row is in turn presented into a cutting position for cutting into the pavement and then withdrawn from the cutting position to present non-cutting surfaces to form periodic cut and uncut portions in the pavement.

2. A milling apparatus as in claim 1 wherein the cutting wheel rotator rotates the cutting wheel in a direction with a forward side moving down and the peripheral speed of the cutting wheel is slower than the forward motion of the milling apparatus.

3. A milling apparatus as in claim 1 wherein the cutting wheel rotator rotates the cutting wheel in a direction with a forward side moving up and the peripheral speed of the cutting wheel is faster than the forward motion of the milling apparatus.

4. A method for forming a rumble strip in pavement, the method comprising;

rotating and moving at least one cutting wheel a fixed distance above a pavement surface, the cutting wheel comprising at least one cutting row of pavement cutters and at least one row of a non-cutting surface disposed transversely, at a periphery of the cutting wheel to present alternating cutting and non-cutting surfaces as the cutting wheel rotates, the cutting wheel rotating at a speed proportional to the moving of the cutting wheel above the pavement such that the cutting rows are in turn presented into a cutting position for cutting into the pavement and then withdrawn from the cutting position as the non-cutting surfaces are presented to form periodic cut and uncut portions in the pavement.

5. A method as in claim 4 wherein the cutting wheel rotator rotates the cutting wheel in a direction with a forward side moving down and the peripheral speed of the cutting wheel is slower than the forward motion of the milling apparatus.

6. A method as in claim 4 wherein the cutting wheel rotator rotates the cutting wheel in a direction with a forward side moving up and the peripheral speed of the cutting wheel is faster than the forward motion of the milling apparatus.

* * * * *